US012654916B2

(12) United States Patent
Klein et al.

(10) Patent No.: US 12,654,916 B2
(45) Date of Patent: Jun. 16, 2026

(54) CONTAINER AND METHOD FOR STORING AND STABILIZING MOISTURE SENSITIVE PRODUCTS

(71) Applicant: CSP Technologies, Inc., Auburn, AL (US)

(72) Inventors: Julien Klein, Auburn, AL (US); Robin Sturm, Auburn, AL (US); Thibaut Schmitt, Auburn, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 0 days.

(21) Appl. No.: 19/120,848

(22) PCT Filed: Oct. 10, 2023

(86) PCT No.: PCT/US2023/034797
§ 371 (c)(1),
(2) Date: Apr. 14, 2025

(87) PCT Pub. No.: WO2024/081219
PCT Pub. Date: Apr. 18, 2024

(65) Prior Publication Data

US 2026/0084874 A1 Mar. 26, 2026

Related U.S. Application Data

(60) Provisional application No. 63/379,533, filed on Oct. 14, 2022.

(51) Int. Cl.
*B65D 51/30* (2006.01)
*B65D 47/18* (2006.01)

(52) U.S. Cl.
CPC ..... *B65D 51/30* (2013.01); *B65D 47/18* (2013.01)

(58) Field of Classification Search
CPC ..... B65D 51/002; B65D 51/30; B65D 51/28; B65D 51/244; B65D 81/266; B65D 81/26; B65D 47/18; B65D 47/06; B65D 83/0409
See application file for complete search history.

(56) References Cited

U.S. PATENT DOCUMENTS 3,897,307 A 7/1975 Porubcan et al.
4,036,360 A 7/1977 Deffeyes
(Continued)

FOREIGN PATENT DOCUMENTS

DE 102004049349 A1 4/2006
EP 0454967 A2 11/1991
(Continued)

OTHER PUBLICATIONS

Tanasova et al., "Laboratory Standard Operating Procedure: Alkali Metals," Journal of Bacteriology, May 12, 2015, pp. 1-3.
(Continued)

*Primary Examiner* — Javier A Pagan
(74) *Attorney, Agent, or Firm* — David B. Gornish; Eckert Seamans Cherin & Mellott LLC

(57) ABSTRACT

A container (20) for storing moisture-sensitive products includes a body (100) having a base (102), a sidewall (104) extending upwardly from the base and leading to an opening that provides access to an interior of the body; an oil (2) disposed within a product compartment (110) in the interior of the body, the product compartment being that portion of the interior of the body in which the oil is disposed while the body is standing upright on the base in a resting position; a cap (200') that covers the opening to form an enclosure that includes the product compartment, the enclosure further including a desiccant compartment positioned above and in fluid communication with the product compartment; and a desiccant material (2000) disposed within the desiccant
(Continued)

compartment configured to scavenge moisture from the enclosure so as to stabilize moisture sensitive products suspended in the oil without directly contacting the oil when the body is in the resting position.

19 Claims, 8 Drawing Sheets

(56) References Cited

U.S. PATENT DOCUMENTS

| | | | | |
|---|---|---|---|---|
| 4,518,696 | A | 5/1985 | Gerhman et al. | |
| 5,439,678 | A | 8/1995 | Dobrogosz et al. | |
| 5,458,875 | A | 10/1995 | Casas-Perez et al. | |
| 5,534,253 | A | 7/1996 | Casas et al. | |
| 5,837,238 | A | 11/1998 | Casas et al. | |
| 5,849,289 | A | 12/1998 | Dobrogosz et al. | |
| 5,911,937 | A | 6/1999 | Hekal | |
| 5,947,274 | A | 9/1999 | Taskis et al. | |
| 6,005,100 | A | 12/1999 | Mandai et al. | |
| 7,214,370 | B2 | 5/2007 | Naidu | |
| 7,413,083 | B2 * | 8/2008 | Belfance | B65D 51/26 206/204 |
| 8,003,179 | B2 | 8/2011 | Merical et al. | |
| 8,785,183 | B2 | 7/2014 | Sjoberg | |
| 9,210,945 | B2 | 12/2015 | Horgan et al. | |
| 9,351,512 | B2 | 5/2016 | Sjoberg | |
| 2005/0271641 | A1 | 12/2005 | Bjorksten et al. | |
| 2007/0098847 | A1 | 5/2007 | Teissier | |
| 2010/0104615 | A1 | 4/2010 | Jiffer | |
| 2011/0287157 | A1 | 11/2011 | Watson | |
| 2012/0034198 | A1 | 2/2012 | Garner et al. | |
| 2016/0039955 | A1 | 2/2016 | Klein et al. | |

FOREIGN PATENT DOCUMENTS

| | | | | |
|---|---|---|---|---|
| EP | 0526977 | A2 | 2/1993 | |
| EP | 1239032 | A1 | 9/2002 | |
| GB | 274578 | A * | 7/1927 | B65D 51/30 |
| KR | 200383738 | Y1 | 5/2005 | |
| TW | M605914 | U | 1/2021 | |
| WO | WO-9604189 | A1 * | 2/1996 | B65D 51/002 |
| WO | 01/37865 | A1 | 5/2001 | |
| WO | WO-2006040019 | A1 * | 4/2006 | B65D 51/30 |
| WO | 2009/140627 | A2 | 11/2009 | |
| WO | WO-2024081219 | A1 * | 4/2024 | B65D 51/30 |

OTHER PUBLICATIONS

International Search Report of PCT/US2023/034797 dated Feb. 8, 2024.

Written Opinion of PCT/US2023/034797 dated Feb. 8, 2024.

* cited by examiner 20
100
2000
308
316
302

20
314
2001
308
320
310
302
100
2
110

20
314
200''
300
214
106
318
304
312
2000
306
100
104
2
110
102

20
200'
212
202
210
206
214
204
2000
314
316
302
312
306
300
304
318
112
100
106
104
2
110
102

CONTAINER AND METHOD FOR STORING AND STABILIZING MOISTURE SENSITIVE PRODUCTS

CROSS-REFERENCE TO RELATED APPLICATIONS

This patent application claims the priority benefit under 35 U.S.C. § 119(e) of U.S. Provisional Application No. 63/379,533, filed on Oct. 14, 2022, the contents of which are herein incorporated by reference.

FIELD OF THE INVENTION

The disclosed concept relates generally to storing products that are sensitive to moisture and oxidation and extending the shelf-life of such products, more particularly to storing the products suspended in oil and prolonging the self-life of the products by using a desiccant material disposed within the packaging that is preferably suspended at least in part above the oil when the packaging is in an upright, resting position.

BACKGROUND OF THE INVENTION

FAO/WHO defines probiotics as live microorganisms which, when administered in adequate amounts, confer a health benefit on the host. The most common microorganisms used as probiotics are lactic-acid producing bacteria, e.g., strains of *Lactobacillus* and *Bifidobacteria*. Lactic-acid producing bacteria are used for their beneficial effect on human or animal health as well as for fermentation processes in the food industry. For example, *Lactobacillus reuteri*, one of the naturally occurring inhabitants of the gastrointestinal tract of animals, is known to have antibacterial activity, see U.S. Pat. Nos. 5,439,678, 5,458,875, 5,534,253, 5,837,238, and 5,849,289. Lactic acid bacteria have also been reported to be used to prevent and treat allergies, see EP 1239032 and WO 01/37865.

The microorganisms marketed for the health and fermentation purposes are often formulated as freeze-dried powders in a low water content environment, e.g., U.S. Pat. No. 3,897,307A. In general, the application of such freeze-dried microorganism faces a limited storage stability of the cells since the available free water content is deleterious for the cells. As such, the microorganisms become less viable, requiring higher dosages to compensate for this loss provided that there are sufficient viable organisms to make the higher dosages possible.

For storage purposes, foil having a plastic layer on one surface on the outside of the compartment, such as a polyethylene laminated aluminum foil, is generally used as packaging material in order to reduce exposure of the freeze-dried lactic acid bacteria to moisture and oxygen. But even when barrier materials are effective at restricting the transmission of water molecules through a package, certain features of the package may still allow for the transmission of water molecules, for example, along the edges of a heat-sealed package. Also, the process of filling the package in itself may contribute to trapping water inside the packaging.

In order to maintain a low level of moisture within a package, sachets including desiccant material have been incorporated within the package to remove the moisture. In order to protect freeze-dried lactic acid bacteria cultures, an oil-based formulation has been used. For example, sunflower seed oil has been used as the liquid suspending medium for properly prepared dry viable *Lactobacillus* cells to improve cell stability at room temperature, see U.S. Pat. No. 4,518,696. In order to increase the stability of *Lactobacillus* cells, the oil (sunflower oil) before formulation has been vacuum-dried before the freeze-dried *Lactobacillus reuteri* was added to the oil, see U.S. Patent Application Publication No. 20050271641. Nevertheless, it may still not be possible to remove all moisture by vacuum-drying of the oil. Further, new moisture may enter the oil formation during packaging or storage in various containers.

To further improve the stability of the lactic acid bacteria cultures, U.S. Pat. No. 8,785,183 (the '183 patent) and U.S. Pat. No. 9,351,512 (the '512 patent) introduce adsorbing moisture from a non-water liquid including oil using a specific moisture adsorbing materials, e.g., especially prepared polymer strips or foils having an incorporated chemical desiccant material such as M-0026 Activ-Strip™ by CSP Technologies, Auburn, USA. Specifically, the '183 and '512 patents use a strip of desiccant polymer or a desiccant film that is in direct contact with the oil for absorbing moisture from the oil disposed within a packaging or container.

FIGS. 1-5 of the present specification show a prior art container 10 that may be used for storing moisture sensitive products suspended in an oil 2. FIG. 1 is a perspective view of a prior art container that stores moisture sensitive products suspended in the oil 2 and includes a desiccant material 1000 submerged within the oil 2; FIG. 2 is a perspective top view of a cap 200 of the prior art container 10 of FIG. 1; FIG. 3 is a perspective view of three different sized prior art containers 10 similar to that shown in FIG. 1 in an open position in which the cap 200 of the containers 10 have been removed; FIGS. 4A and 4B show alternative perspective views of a dispensing member 300 which may be assembled to the prior art container 10 of FIGS. 1 and 3; and FIG. 5 illustrates the prior art container 10 of FIG. 1 in an open position and having the prior art dispensing member 300 of FIGS. 4A and 4B assembled thereto, with an oil suspension of moisture sensitive products disposed within the container 10 and the prior art desiccant material 1000 submerged within the oil 2.

In particular, as shown in FIGS. 1 and 5, the container 10 includes a body 100, a cap 200, an oil 2, and a desiccant material 1000. The body 100 has a base 102, a sidewall 104 extending upwardly from the base 102 and leading to an opening that provides access to an interior of the body 100. The oil 2 is disposed within a product compartment 110 in the interior of the body 100. The product compartment 110 is that portion of the interior of the body 100 in which the oil 2 is disposed while the body 100 is standing upright on the base 102 in a resting position. The oil 2 is dispensed from the dispensing member 300 when the body 100 is oriented upside down on the base 102 in the dispensing position. The oil 2 is represented by cross-hatching in relevant figures. The moisture sensitive products may be suspended or formulated in a medium other than the oil (pharmaceutical oil, pure vegetable oil, etc.), but the main embodiment of the prior art includes the oil 2 as the medium in which the moisture sensitive products are suspended or formulated.

The cap 200 covers the opening to form an enclosure that includes the product compartment 110 and a headspace above the product compartment 110. Optionally, the container 10 includes a dispensing member 300 (see FIGS. 4A-5) that dispenses a dosage of the products suspended in the oil 2 while the cap 200 is open and the body 100 is being oriented upside down in a dispensing position.

The desiccant material 1000 is configured to scavenge moisture from the enclosure so as to stabilize moisture sensitive products suspended in the oil 2. In FIG. 1, the desiccant material 1000 is disposed within the product compartment 110 so as to be submerged within the oil 2. As such, the desiccant material 1000 is effectively at all times in direct contact with the oil 2 and capable of adsorbing moisture from the oil 2. The desiccant material 1000 may be a strip of desiccant polymer or a specific desiccant film such as M-0026 Activ-Strip™ manufactured by CSP Technologies, Auburn, USA or a film with a desiccant material incorporated as described in U.S. Pat. No. 8,003,179.

As shown in FIG. 2, the cap 200 has an annular top 202, a skirt 204 depending downwardly from the annular top 202, a cylindrical blocker 212 extending downwardly from an inner surface of the annular top 202, an annular sealing ridge 210 extending downwardly from the inner surface of the annular top 202, and a plurality of threads 208 disposed on an inner surface of the skirt 204. The skirt 204 may include ridges on its external surface for an easy grab and twist for opening the cap 200 by a user. The cylindrical blocker 212 may include a base (not shown) embedded within the inner surface of the annular top 202 and a blocker sidewall 214 that rests within a groove 314 (see FIGS. 4B and 5) of the dispensing member 300 when the cap 200 is closed. The cylindrical blocker 212 blocks the flow of the products suspended in the oil 2 when the cap 200 is closed. The annular sealing ridge 210 is disposed concentrically to the skirt 204 and the cylindrical blocker 212 and is positioned between the skirt 204 and the cylindrical blocker 212. The annular sealing ridge 210 is configured to sealingly engage with an upper surface of a flange 302 (see FIGS. 4A-5) of the dispensing member 300. The plurality of threads 208 engage with a plurality of threads 108 (see FIG. 3) disposed on the outer surface of an upper section (e.g., a neck) 106 of the body 110 when the cap 200 is closed. The engagement between the annular sealing ridge 210 and the flange 302 creates a moisture tight seal between the cap 200 and the dispensing member 300, and, together with the engagement between the flange 302 and a portion 112 (e.g., an upper rim) of the neck 106 of the body, as described with respect to FIGS. 4A-B, creates a preferably moisture tight seal between the body 100 and the cap 200.

As shown in FIG. 3, a plurality of bodies 100,100',100" having different sizes can be used for the prior art container 10 of FIG. 1. Optionally, the body 100 has a length of 76 mm. Optionally, the body 100' has a length of 61 mm. Optionally, the body 100" has a length of 53 mm. These are for illustrative purposes only and the size and/or length of the body may vary depending on circumstances, needs and/or preferences of the user.

As illustrated in FIGS. 4A-B, the prior art dispensing member 300 includes an outlet 316 that is configured to dispense a dosage of the products suspended in the oil 2 while the cap 200 is open and the body 100 is being oriented upside down in the dispensing position. The dispensing member 300 also includes a flange 302 that sealingly engage with a portion of the upper section 106 of the body 100, e.g., an upper rim 112 of a neck 106 formed in the upper section of the body 100 (see FIG. 5). The dispensing member 300 also includes a first dispensing member sidewall 304 depending downwardly from the flange 302 and inwardly towards a bottom portion of the outlet 316, a dispensing member base 306 extending inwardly from a bottom edge of the first dispensing member sidewall 304 and forming the dispensing member opening 310 and a dispensing member base opening 308, a second dispensing member sidewall 312 extending upwardly from an inner periphery of the dispensing member base opening 308 towards a top portion of the outlet 316, and a projection 318 extending downwardly from the dispensing member opening 310. The first and second dispensing member sidewalls 304,312 and the dispensing member base 306 together form a groove 314 that receives the blocker sidewall 212 of the cylindrical blocker 210 of the cap 200 when the cap 200 is closed. The dispensing member opening 310 enables the groove 314 to be in fluid communication with the product compartment 110.

However, adding the desiccant materials (e.g., desiccant strips, foils, or films directly into the oil, as disclosed in the '183 and '512 patents or illustrated in FIGS. 1 and 5, increases risks such as contamination (e.g., stain from the molding process or from handling), undesired interactions between probiotics suspended in the oil and the desiccant strips, foils, or films, or release of plastic injected particles or burrs into the oil. As such, these desiccant strips, foils, or films need to be produced in a more demanding and well-controlled process, which is time consuming and costly. Further, the desiccant materials placed inside the oil reduce the available volume of the oil, resulting in increase of the size of the packing or the container for storing the lactic-acid bacteria culture. Such increased size leads to an increase in packaging and transportation costs. Additionally, there is also a limitation to the volume of the desiccant material that can be placed inside the oil. Moreover, the use of the strip or film submerged within the oil may not be preferred where a long shelf life is required and there is a risk that the film is "exhausted" too quickly due to rapid moisture adsorption, or where an alternative sorbent material is appropriate.

There is thus a need for improvement in packaging moisture sensitive products suspended in oil and extending the shelf-life of such products.

There is also a need for improved moisture absorbing material for scavenging moisture and stabilizing moisture sensitive products suspended in the oil.

SUMMARY OF THE INVENTION

These needs, and others, are met by a container for storing moisture sensitive products. The container includes a body having a base, a sidewall extending upwardly from the base and leading to an opening that provides access to an interior of the body; an oil disposed within a product compartment in the interior of the body, the product compartment being that portion of the interior of the body in which the oil is disposed while the body is standing upright on the base in a resting position; a cap that covers the opening to form an enclosure that includes the product compartment, the enclosure further including a desiccant compartment positioned above and in fluid communication with the product compartment; and a desiccant material disposed within the desiccant compartment configured to scavenge moisture from the enclosure so as to stabilize moisture sensitive products suspended in the oil without directly contacting the oil when the body is in the resting position.

Optionally, in any embodiment of the container according to the disclosed concept, the container further includes a dispensing member that includes an outlet that is configured to dispense a dosage of the oil while the cap is open and the body is being oriented upside down in a dispensing position, the dispensing member sealingly engaging with an upper section of the body, the dispensing member further including a dispensing member opening that enables the desiccant compartment to be in fluid communication with the product compartment.

Optionally, in any embodiment of the container according to the disclosed concept, the dispensing member includes the desiccant compartment.

Optionally, in any embodiment of the container according to the disclosed concept, the dispensing member further includes a holding component that engages with a portion of the desiccant material so as to retain the desiccant material within the desiccant compartment when the body is in the dispensing position.

Optionally, in any embodiment of the container according to the disclosed concept, the dispensing member further includes a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming the dispensing opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming the desiccant compartment.

Optionally, in any embodiment of the container according to the disclosed concept, the projection has a projection opening opposite the dispensing member opening, the projection opening and the dispensing member opening together enabling the desiccant compartment to be in fluid communication with at least the product compartment or a remaining portion of the enclosure.

Optionally, in any embodiment of the container according to the disclosed concept, the desiccant material is disposed within a lower section of the desiccant compartment and surrounds a lower portion of the second dispensing member sidewall.

Optionally, in any embodiment of the container according to the disclosed concept, the desiccant material has a shape of a ring.

Optionally, in any embodiment of the container according to the disclosed concept, the cap includes a blocking element that extends downwardly into the desiccant compartment and surrounds a portion of the second dispensing member sidewall when the cap is closed.

Optionally, in any embodiment of the container according to the disclosed concept, the blocking element of the cap is made of the desiccant material.

Optionally, in any embodiment of the container according to the disclosed concept, the desiccant material is molded onto the cap in a multi-shot injection process.

Optionally, in any embodiment of the container according to the disclosed concept, the moisture sensitive products include lactic-acid producing bacteria, optionally including *Lactobacillus* and *Bifidobacteria*.

In an optional aspect of the disclosed concept, a container for storing moisture sensitive products is provided. The container includes a body having a base, a sidewall extending upwardly from the base and leading to an opening that provides access to an interior of the body; an oil disposed within a product compartment in the interior of the body, the product compartment being that portion of the interior of the body in which the oil is disposed while the body is standing upright on the base in a resting position; a cap that covers the opening to form an enclosure that includes the product compartment and a headspace positioned above and in fluid communication with the product compartment; and a dispensing member sealingly engaging with an upper section of the body, the dispensing member having an outlet configured to dispense a dosage of the oil when the body is in a dispensing position, the dispensing member including an upper section that is not made of a desiccant material and a lower section that is made of the desiccant material, the desiccant material being disposed at least in part within the headspace when the body is in the resting position, the desiccant material being configured to scavenge moisture from the enclosure so as to stabilize moisture sensitive products suspended in the oil.

Optionally, in any embodiment of the container according to the disclosed concept, in the dispensing position the cap is open and the body is oriented upside down.

Optionally, in any embodiment of the container according to the disclosed concept, the dispensing member further includes a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming a dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming a groove that is a part of the headspace.

Optionally, in any embodiment of the container according to the disclosed concept, the projection has a projection opening opposite the dispensing member opening, the projection opening and the dispensing member opening together enabling the groove to be in fluid communication with the product compartment or a remaining portion of the headspace.

Optionally, in any embodiment of the container according to the disclosed concept, the lower section of the dispensing member includes the projection, the dispensing member base, a lower portion of the second dispensing sidewall, and a bottom portion of the outlet.

Optionally, in any embodiment of the container according to the disclosed concept, the desiccant material is molded onto the cap in a multi-shot injection process.

Optionally, in any embodiment of the container according to the disclosed concept, the products include lactic-acid producing bacteria, optionally including *Lactobacillus* and *Bifidobacteria*.

In an optional aspect of the disclosed concept, a method for stabilizing moisture sensitive products suspended in oil is provided. The method includes providing a container that includes (i) a body that has a base, a sidewall extending upwardly from the base and leading to an opening that provides access to an interior of the body, (ii) a cap that covers the opening to form an enclosure that includes a product compartment that is a portion of the interior of the body in which an oil is disposed while the body is standing upright on the base in a resting position, the enclosure further including a desiccant compartment positioned above and in fluid communication with the product compartment, and (iii) a desiccant material disposed within the desiccant compartment; and scavenging moisture, by the desiccant material, from the enclosure, so as to stabilize moisture sensitive products suspended in the oil without directly contacting the oil when the body is in the resting position.

Optionally, in any embodiment of the method according to the disclosed concept, the container further includes a dispensing member that includes an outlet that is configured to dispense a dosage of the oil while the cap is open and the body is oriented upside down in a dispensing position, the dispensing member sealingly engaging with an upper section of the body, the dispensing member further including a dispensing member opening that enables the desiccant compartment to be in fluid communication with the product compartment.

Optionally, in any embodiment of the method according to the disclosed concept, the dispensing member further includes a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming the dispensing opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming the desiccant compartment.

Optionally, in any embodiment of the method according to the disclosed concept, the desiccant material is disposed at a lower section of the desiccant compartment and surrounds a lower portion of the second dispensing member sidewall.

Optionally, in any embodiment of the method according to the disclosed concept, the desiccant material has a shape of a ring.

Optionally, in any embodiment of the method according to the disclosed concept, the cap includes a blocking element that extends downwardly into the desiccant compartment and surrounds a portion of the second dispensing member sidewall when the cap is closed.

Optionally, in any embodiment of the method according to the disclosed concept, the blocking element of the cap is made of the desiccant material.

Optionally, in any embodiment of the method according to the disclosed concept, providing the container includes molding the desiccant material onto the cap in a multi-shot injection process.

In an optional aspect of the disclosed concept, a method for stabilizing moisture sensitive products suspended in oil is provided. The method includes providing a container that includes a body that has a base, a sidewall extending upwardly from the base and leading to an opening that provides access to an interior of the body, a cap that covers the opening to form an enclosure that includes a product compartment that is a portion of the interior of the body in which an oil is disposed while the body is standing upright on the base in a resting position, a dispensing member that sealingly engages with an upper section of the body and has an outlet configured to dispense a dosage of the oil when the body is in a dispensing position, the dispensing member including an upper section that is not made of a desiccant material and a lower section that is made of the desiccant material, the desiccant material being disposed at least in part within the headspace when the body is in the resting position; and scavenging moisture, by the desiccant material, from the enclosure so as to stabilize moisture sensitive products suspended in the oil when the body is in a resting position.

Optionally, in any embodiment of the method according to the disclosed concept, the cap is open and the body is oriented upside down in the dispensing position.

Optionally, in any embodiment of the method according to the disclosed concept, the dispensing member further includes a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming a dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming a groove that is a part of the headspace.

Optionally, in any embodiment of the method according to the disclosed concept, the dispensing member further includes a projection extending downwardly from the dispensing member opening, the projection having a projection opening opposite the dispensing member opening, the projection opening and the dispensing member opening together enabling the groove to be in fluid communication with the product compartment or a remaining portion of the headspace.

Optionally, in any embodiment of the method according to the disclosed concept, the lower section of the dispensing member includes the projection, the dispensing member base, a lower portion of the second dispensing sidewall, and a bottom portion of the outlet.

Optionally, in any embodiment of the method according to the disclosed concept, providing the container includes molding the desiccant material in a multi-shot injection process.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
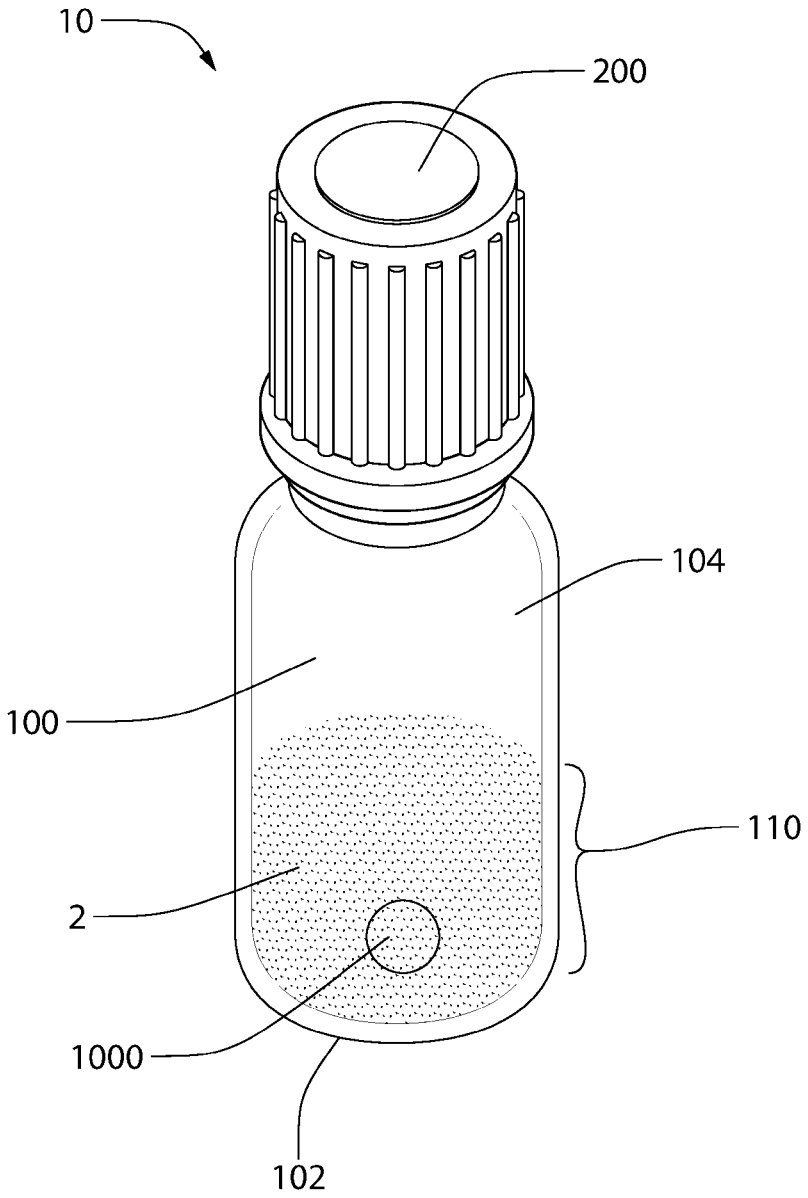
PRIOR ART FIG. 1
FIG. 1 is a perspective view of a prior art container that stores moisture sensitive products suspended in an oil and includes a desiccant material submerged within the oil.
Figure 2:
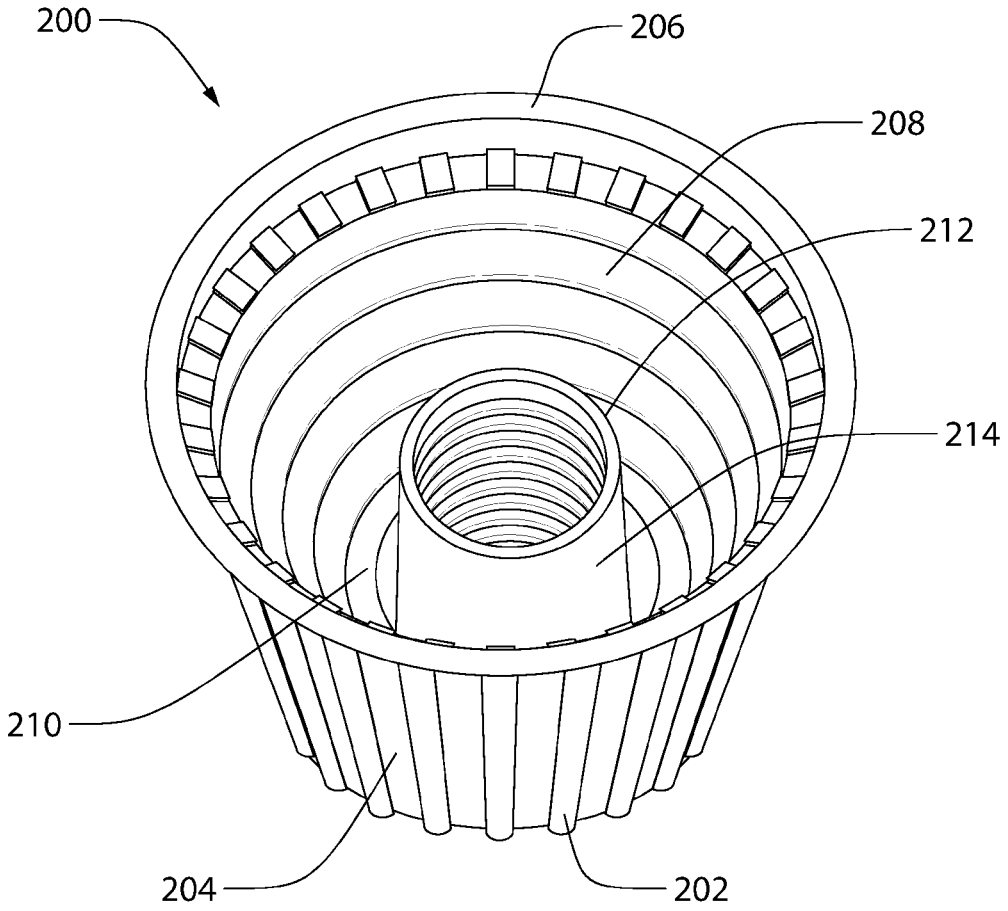
PRIOR ART FIG. 2
FIG. 2 is a perspective top view of a cap of the prior art container of FIG. 1.
Figure 3:
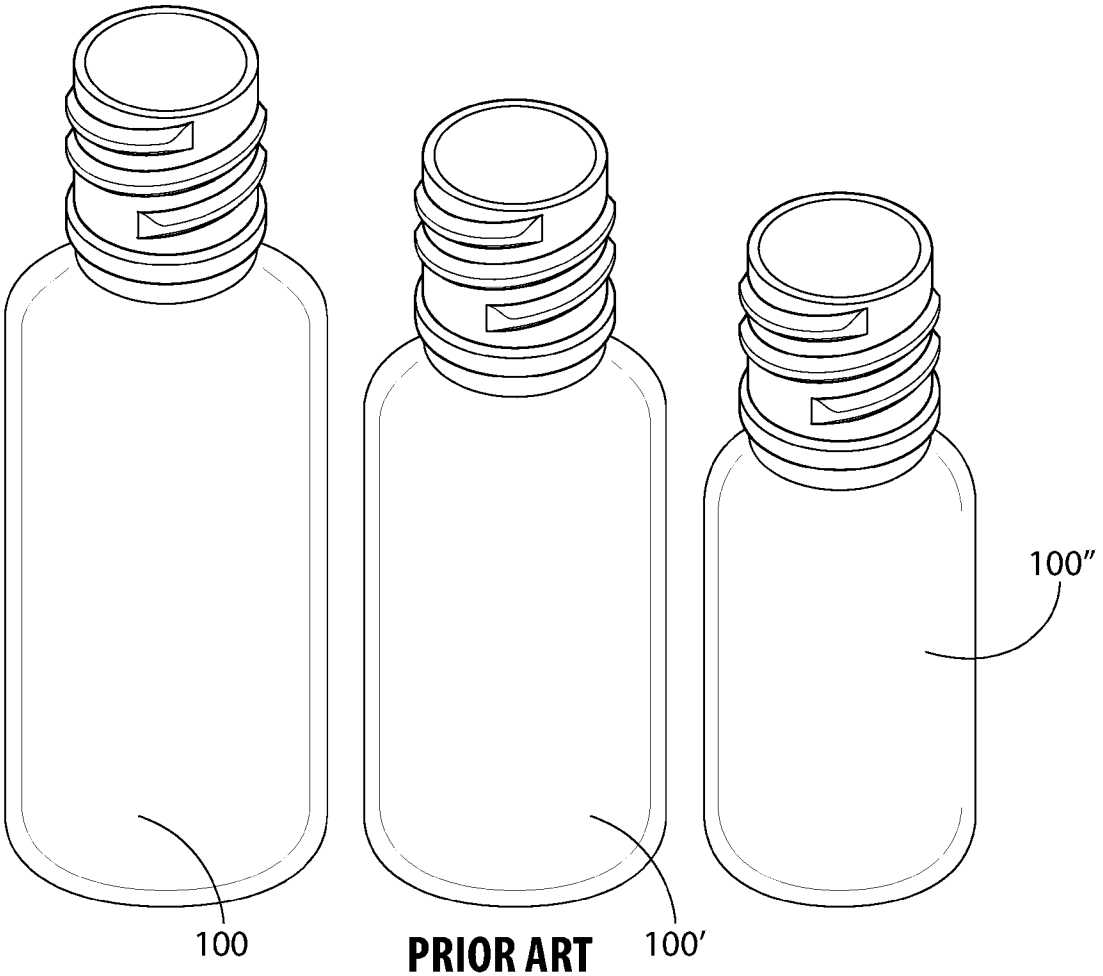
PRIOR ART FIG. 3
FIG. 3 is a perspective view of three different sized prior art containers similar to that shown in FIG. 1 in an open position in which the cap of the containers has been removed.
Figure 4B:
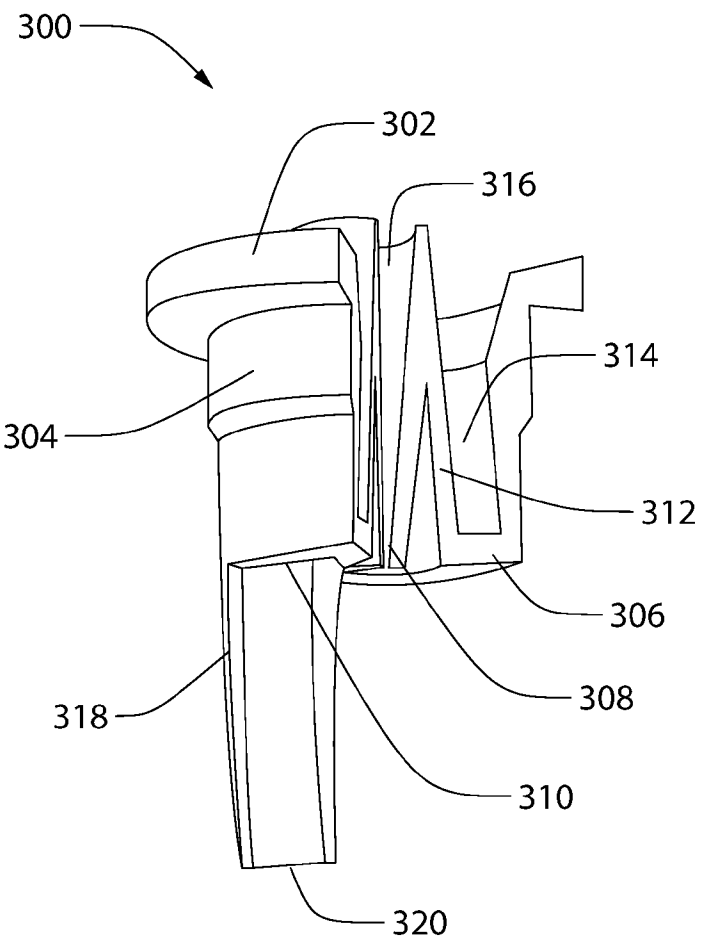
PRIOR ART FIG. 4B
FIGS. 4A and 4B show alternative perspective views of a dispensing member which may be assembled to the prior art container of FIGS. 1 and 3.
Figure 4A:
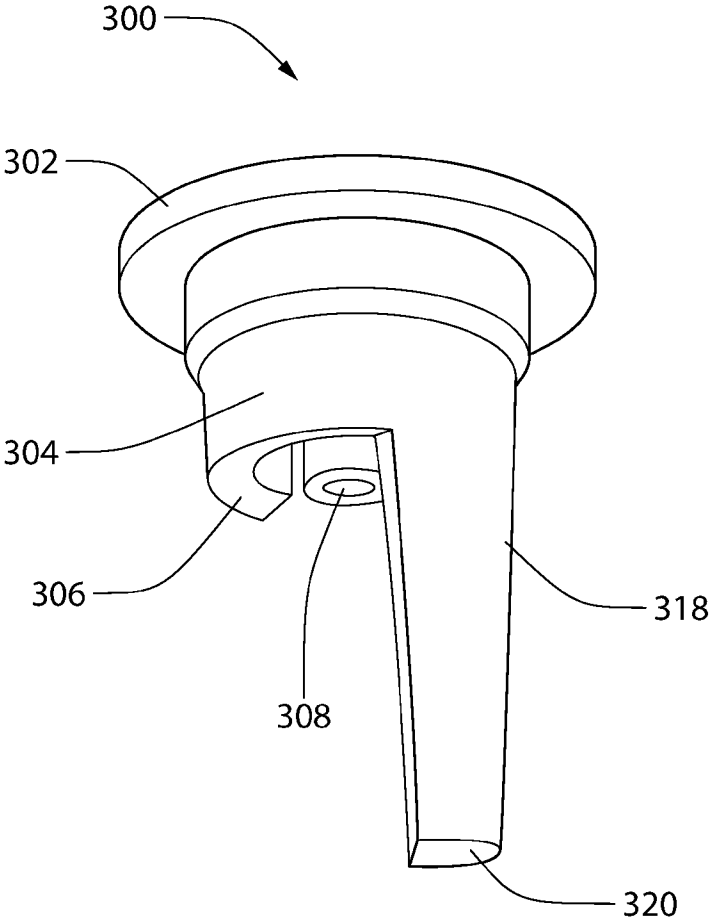
PRIOR ART FIG. 4A
Figure 5:
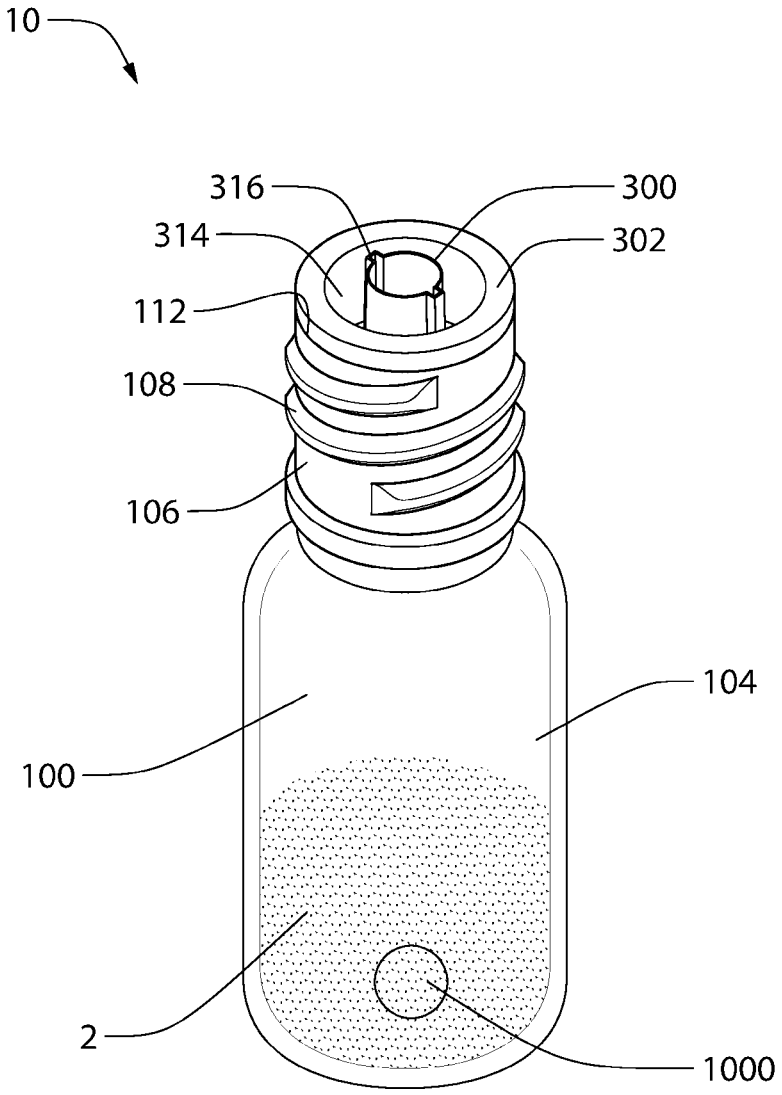
PRIOR ART FIG. 5
FIG. 5 illustrates the prior art container of FIG. 1 in an open position and having the prior art dispensing member of FIGS. 4A and 4B assembled thereto, with an oil suspension of moisture sensitive products disposed within the container and a desiccant material submerged within the oil.
Figures 6A, 6B, 6C, 6D:
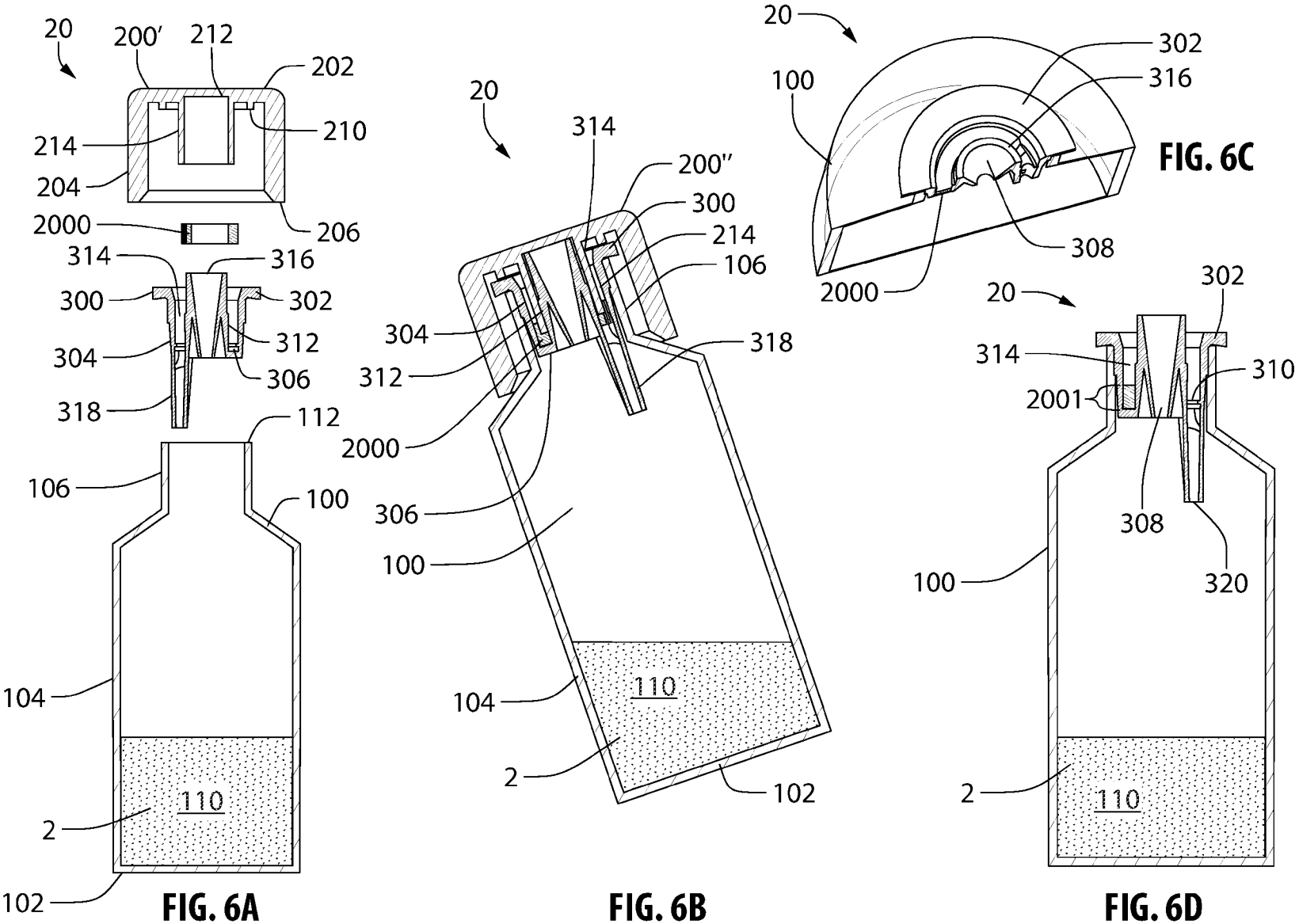
FIG. 6A is an exploded cross-sectional view of a container for storing moisture sensitive products, the container including a desiccant material disposed within a desiccant compartment of an enclosure formed by the cap and body of the container in accordance with an optional aspect of the disclosed concept.
FIG. 6B is a cross sectional view of the container of FIG. 6A in a closed position.
FIG. 6C is a top perspective cross-sectional view of the container of FIG. 6A in an open position in which the cap has been removed.
FIG. 6D is a cross-sectional view of the container of FIG. 6A when the cap is in the open position.

The disclosed concept will now be described more fully with reference to the accompanying drawings, in which several embodiments are shown. This invention may, however, be embodied in many different forms and should not be construed as limited to the embodiments set forth here. Rather, these embodiments are examples of the invention, which has the full scope indicated by the language of the claims. Like numbers refer to like elements throughout. Unless indicated otherwise, the features characterizing the embodiments and aspects described in the following may be combined with each other, and the resulting combinations are also embodiments of the present invention.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

As used herein, "and/or" means that either or both of the items separated by such terminology are involved. For example, the phrase "A and/or B" would mean A alone, B alone, or both A and B.

As used herein, "generally" means "in a general manner" relevant to the term being modified as would be understood by one of ordinary skill in the art.

As used herein, the statement that two or more parts or components "engage" one another shall mean that the parts exert a force against one another cither directly or through one or more intermediate parts or components.

As used herein, the phrases "sealingly engage" or "sealing engagement" shall refer to elements which contact each other in a manner such that a generally liquid-tight and optionally moisture-tight seal is formed therebetween.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Generally speaking, as used herein, the term "moisture tight" is defined as having a moisture ingress (after three days) of less than 1500 μg of water, in another embodiment, less than 500 μg of water, in a further embodiment, less than 300 μg of water, in yet another embodiment, less than 150 μg of water, as determined by the following test method: (a) place one gram plus or minus 0.25 grams of molecular sieve in the container and record the weight; (b) fully close the container; (c) place the closed container in an environmental chamber at conditions of 80% relative humidity and 72° F.; (d) after one day, weigh the container containing the molecular sieve; (e) after four days, weigh the container containing the molecular sieve; and (f) subtract the first day sample from the fourth day sample to calculate the moisture ingress of the container in units of micrograms of water. A preferred rate of ingress of moisture into a moisture tight sealed container produced according to an aspect of the disclosed concept is in the range of about 200-300 μg/day of water or less. A "moisture tight" seal therefore is a sealing engagement that alone, or in combination with additional sealing engagements, help to render a container "moisture tight" per the above definition.

Referring now in detail to the figures, where like reference numerals refer to like parts throughout, FIGS. 6A-8C illustrate different embodiments of a container 20, 30, 40 in accordance with optional aspects of the disclosed concepts. While these embodiments utilize the prior art container 10 with certain variations, it is understood that any other containers with varying shapes, sizes, and/or components that are capable of being used for storing moisture sensitive products may be used. The oil 2 is represented by cross-hatching in relevant figures. The moisture sensitive products may be suspended or formulated in a medium other than the oil (pharmaceutical oil, pure vegetable oil, etc.), but the main embodiments of the present disclosure include the oil 2 as the medium in which the moisture sensitive products are suspended or formulated.

FIGS. 6A-D show a cross section of a container 20 for storing moisture sensitive products suspended in an oil 2 in accordance with an optional aspect of the disclosed concept. The container 20 includes some similar features and components as those of the prior art container 10 of FIG. 1, but differs from the container 10 in that container 20 according to an optional aspect of the disclosed concept includes a desiccant material 2000 that is disposed within a desiccant compartment 2001 and that the desiccant material 2000 is configured to scavenge moisture from the enclosure without directly contacting the oil 2 when the body 100 is in the resting position (i.e., standing upright). The example embodiment as illustrated in FIGS. 6A-D according to the present disclosure is novel and advantageous in that it allows adsorbing moisture from the oil 2 by a desiccant material 2000 without directly contacting the oil 2, and thus, avoiding the previously mentioned or other known problems and risks associated with having the desiccant material being in direct contact with the oil for scavenging the moisture therefrom.

The desiccant material 2000 may be an active polymer component that may be a desiccant entrained polymer that is a unitary component made of a single piece of material. An entrained polymer, whether entrained with desiccant or another active agent, may include a base polymer (for structure), a desiccant (or other active agent) and optionally a channeling agent. These types of active entrained polymers and methods of making and using the same are disclosed, e.g., in Applicant's U.S. Pat. Pub. No. 2016/0039955, which is incorporated by reference herein and is attached hereto as Appendix A. Optionally, the entrained polymer may be in the form of a film that is loose or optionally heat staked to a surface.

As used herein, the term, "entrained polymer" is defined as a monolithic material formed from at least one matrix polymeric material and an active agent and optionally also entrained or distributed throughout one of the channels. An entrained polymer thus may be a two phase formulation (i.e., comprising a base polymer and active ingredient, without a channeling agent) or three phase formulation (i.e., comprising a base polymer, active agent and channeling agent). One entrainment polymer having one of the active agents in particulate form is referred to herein as "microparticle entrainment polymer". One entrainment polymer having one of the mineral forms of the active agent is referred to herein as "mineral entrainment polymer".

As used herein, the term, "entrained polymer composition" is defined as an entrained polymer or a formulation that produces an entrained polymer.

As used herein, the term, "active agent" is defined as a material, which (1) is immiscible with the matrix polymer and does not melt when mixed and heated with the matrix polymer and the channeling agent, i.e., has a melting point above one of the melting points of the matrix polymer or channeling agent, and (2) acts on, interacts with or reacts with the selected material. The term "active agent" may include, but is not limited to, materials that absorb, adsorb, or release (selected materials. One active agent in particulate form is referred to herein as "microparticulate active agent". One of the mineral forms of active agents is referred to herein as "mineral active agent". The active agent according to the disclosed concept may be a microparticulate active agent, but (unless otherwise claimed). The presently disclosed technology should not be considered limited to microparticulate active agents. The techniques presently disclosed are, however, particularly suitable for entrained polymers formed from a mineral active material (e.g., molecular sieves or silica gel).

As used herein, the term, "matrix polymer" is optionally a polymer having a gas transfer rate to a selected material that is substantially less than, or substantially equal to the gas transfer rate of the channeling agent to the selected material. For example, this delivery rate will be a water vapor delivery rate in embodiments where the selected material is moisture and the active agent is a water absorbing desiccant. The primary function of the matrix polymer is to provide a structure for the entrained polymer. Suitable matrix polymers may comprise thermoplastic polymers, e.g., polyolefin (such as polypropylene and polyethylene), polyisoprene, polybutadiene, polybutene, polysiloxane, polycarbonate, polyamide, ethylene-vinyl acetate copolymer, ethylene-methacrylate copolymer, polyvinyl chloride, polystyrene, polyester, polyanhydride, polyacrylonitrile, polysulfone, polyacrylate, acrylic acid, polyurethane, polyacetal, or the like or mixtures thereof.

As used herein, the term, "matrix polymer material" is defined as a material comprising a matrix polymer and optionally an additive. When no additive is added, the matrix polymer material is made of matrix polymer. Optionally, the matrix polymer and additives are miscible.

As used herein, the term, "channeling agent" is defined as a material, preferably a type of polymer, that is immiscible with the matrix polymer or matrix polymer material and that has an affinity for transporting a gaseous phase at a faster rate than the matrix polymer or matrix polymer material. Optionally, a channeling agent is capable of forming channels through the entrained polymer when forming the entrained polymer by mixing the channel agent with the matrix polymer or matrix polymer material. Optionally, such channels are capable of transporting a selected material through the entrained polymer at a faster rate than either the matrix polymer or the matrix polymer material alone.

As used herein, the term, "additive" is defined as being added to a matrix polymer to modify one of the particular properties.

Referring to this comparison of the water vapor transmission rate of the matrix polymer and the channeling agent, in one embodiment, the channeling agent has a water vapor transmission rate of at least twice the water vapor transmission rate of the matrix polymer, optionally at least five times the water vapor transmission rate of the matrix polymer, optionally at least ten times the water vapor transmission rate of the matrix polymer, optionally at least twenty times the water vapor transmission rate of the matrix polymer, optionally at least fifty times the water vapor transmission rate of the matrix polymer, optionally at least one hundred times the water vapor transmission rate of the matrix polymer.

As used herein, the terms "monolithic", "monolithic structure" or "monolithic composition" are defined as a composition or material that is not composed of two or more discrete macrolayers. Accordingly, a "monolithic composition" does not contain a multilayer composite.

As used herein, the term "phase" is defined as a portion or component of a monolithic structure or uniformly distributed throughout a composition therein to impart monolithic properties to the structure or composition.

As used herein, the term, "the selected material" is defined as a material that acts on, is acted upon by, or interacts or reacts with, the active agent and is capable of being transported through the channels of the entrained polymer. For example, in embodiments where a desiccant is used as the active agent, the selected material may be moisture or a gas that may be absorbed by the desiccant.

As used herein, the terms "channels" or "interconnect channels" are defined as a through-going matrix polymer formed by a channeling agent, and may be channels that are interconnecting with each other.

As used herein, the term "three-phase" is defined to include one of three or more phases of a monolithic composition or structure. An example of a three-phase composition that may be used in accordance with the disclosed concepts will be an entrained polymer formed from a matrix polymer, an active agent, and a channeling agent. Optionally, a three-phase composition or structure may comprise an additional phase, e.g., a colorant.

Referring back to FIGS. 6A-D, the container 20 includes the body 100, the oil 2, the cap 200' and the desiccant material 2000. The body 100 has the base 102, the sidewall 104 extending upwardly from the base 102 and leading to the opening that provides access to the interior of the body 100. The oil 2 is disposed within the product compartment 110 in the interior of the body 100. The product compartment 110 is that portion of the interior of the body 100 in which the oil 2 is disposed while the body 100 is standing upright on the base 102 in the resting position. The cap 200' covers the opening to form an enclosure that includes the product compartment 110 and a desiccant compartment 2001 positioned above and in fluid communication with the product compartment 110. The desiccant material 2000 is disposed within the desiccant compartment 2001 (see FIG. 6D) and configured to scavenge moisture from the enclosure so as to stabilize moisture sensitive products suspended in the oil 2 without directly contacting the oil 2 when the body 100 is in the resting position.

Optionally, the container 20 also includes a dispensing member 300 that includes an outlet 316 that is configured to dispense a dosage of the products suspended in the oil 2 while the cap 200' is open and the body 100 is being oriented upside down in the dispensing position. The dispensing member 300 sealingly engages with a portion 112 (e.g., an upper rim) of an upper section 106 (e.g., a neck) of the body 100 and also includes a dispensing member opening 310 that enables the desiccant compartment 2001 to be in fluid communication with the product compartment 110.

The dispensing member 300 includes the desiccant compartment 2001 within the groove 314. Optionally, the dispensing member 300 also includes a holding component (not shown) that engages with a portion of the desiccant material 2000 so as to retain the desiccant material 2000 within the desiccant compartment 2001 when the body 100 is in the dispensing position. Optionally, the dispensing member 300 may also include a flange 302 sealingly engaging with the portion 112 of the upper section 106 of the body 100, a first dispensing member sidewall 304 depending downwardly from the flange 302 and inwardly towards a bottom portion of the outlet 316, a dispensing member base 306 extending inwardly from a bottom edge of the first dispensing member sidewall 304 and forming the dispensing member opening 310 and a dispensing member base opening 308, a second dispensing member sidewall 312 extending upwardly from an inner periphery of the dispensing member base opening 310 towards a top portion of the outlet 316, and a projection 318 extending downwardly from the dispensing member opening 310. The first and second dispensing member sidewalls 304,312 and the dispensing member base 306 together form the desiccant compartment 2001. Optionally, the projection 318 may have a projection opening 320 opposite the dispensing member opening 310. The projection opening 320 and the dispensing member opening 310 together enable the desiccant compartment 2001 to be in fluid communication with at least the product compartment 110 or a remaining portion of the enclosure. Optionally, the desiccant material 2000 is disposed within a lower section of the desiccant compartment 2001 and surrounds a lower portion of the second dispensing member sidewall 312. Optionally, the desiccant material 2000 has a shape of a ring with a cut-out for the dispensing member opening 310 such that the desiccant material 2000 surrounds the lower portion of the second dispensing member sidewall 312 without blocking the dispensing member opening 310. It is to be understood that the shape of the desiccant material 2000 is not limited to a shape of ring, but may vary depending on the circumstances, needs or preferences.

Figure 7C:
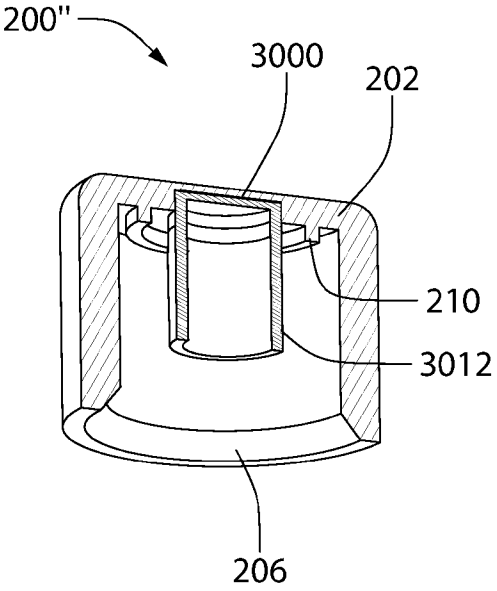
FIG. 7C is a perspective cross-sectional view of the cap of the container of FIG. 7A.
Figure 7B:
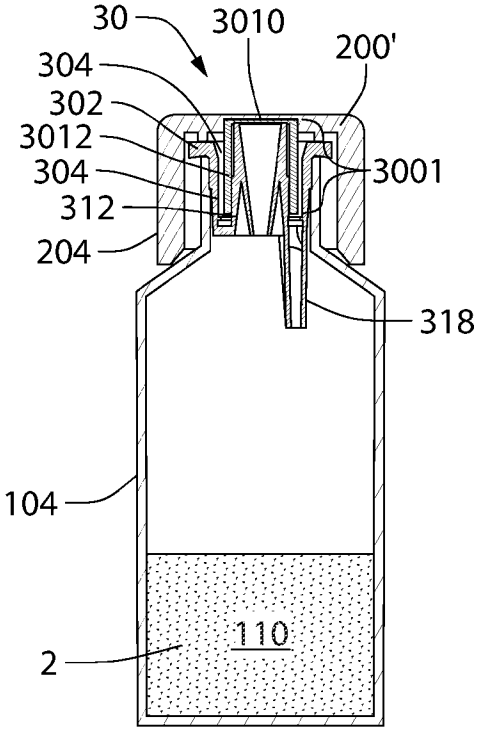
FIG. 7B is a cross-sectional view of the container of FIG. 7A a closed position.
Figure 7A:
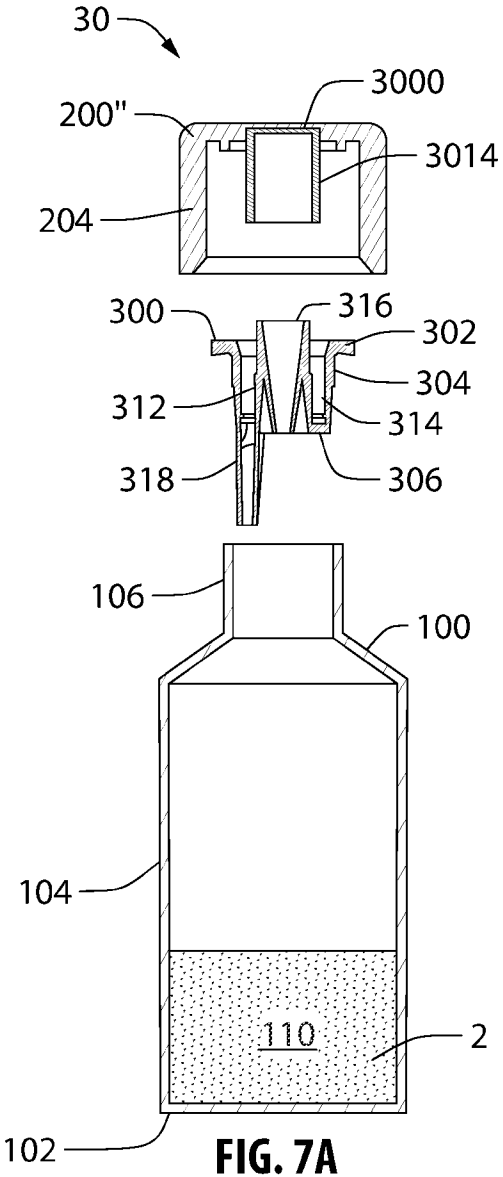
FIG. 7A is an exploded cross-sectional view of a container for storing moisture sensitive products, the container including a desiccant material disposed within a desiccant compartment of an enclosure formed by the cap and body of the container in accordance with an alternative optional aspect of the disclosed concept.

FIGS. 7A-C illustrate a cross section of a container 30 for storing moisture sensitive products in accordance with an alternative optional aspect of the disclosed concept. The container 30 has similar features and components with the container 10 and 20, except that the cylindrical blocker 3000 of the cap 200" of the container 30 is made of a desiccant material and is disposed within the desiccant compartment 3001 (FIG. 7B) formed mainly by the first and second dispensing member sidewalls 304,312 and the dispensing member base 306 of the dispensing member 300. The cylindrical blocker 3000 includes a blocker base 3010 and a blocker sidewall 3012 depending downwardly therefrom. Optionally, the blocker base 3010 may be embedded within a bottom surface of an annular top 202 of the cap 200". The blocker sidewall 3012 extends downwardly into the desiccant compartment 3001 and surrounds a portion of the second dispensing member sidewall 212 when the cap 200" is closed. Optionally, the cylindrical blocker element 3000 surrounds a substantial portion (e.g., without limitation, 70-95% of the surface) of the second dispensing member sidewall 212 when the cap 200" is closed. Optionally, the desiccant material 3000 is molded onto the cap 200" in a multi-shot injection process. The moisture sensitive products include lactic-acid producing bacteria, optionally including *Lactobacillus* and *Bifidobacteria*.

The embodiment as illustrated in FIGS. 7A-C is novel and advantageous in that it also allows adsorbing moisture from the oil 2 by a desiccant material 3000 without being in direct contact with the oil 2, and thus, avoiding the previously mentioned or other known problems and risks associated with having the desiccant material 3000 being in direct contact with the oil 2 for scavenging the moisture therefrom. Further, the desiccant material 3000 likely has a larger volume than the desiccant material 2000 of the container 20 of FIGS. 6A-D, thereby providing an even more increased scavenging and stabilizing capacity than those of the desiccant material 2000.

Figure 8C:
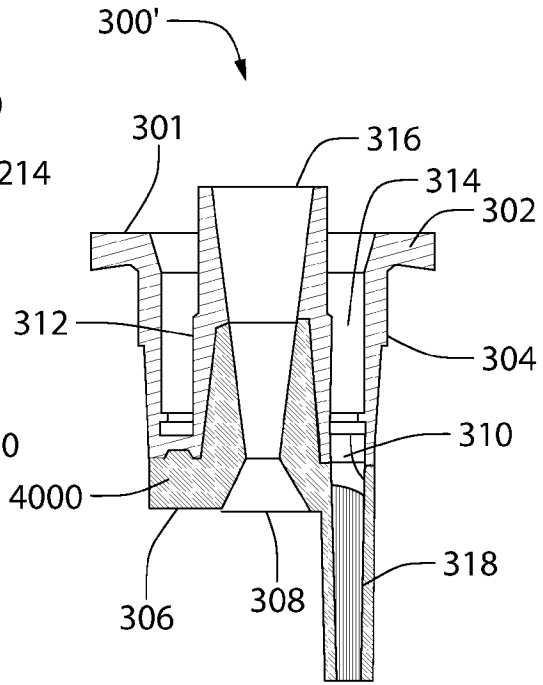
FIG. 8C is a cross-sectional view of the dispensing member of the container of FIG. 8A.
Figure 8B:
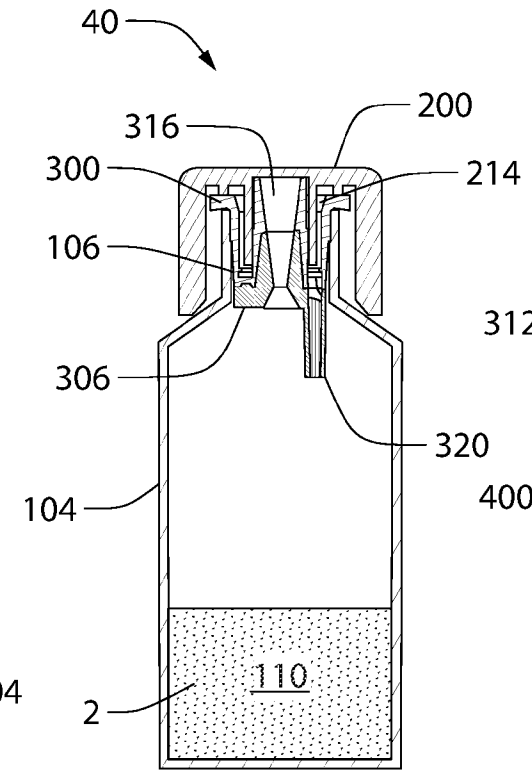
FIG. 8B is a cross-sectional view of the container of FIG. 8A in a closed position.
Figure 8A:
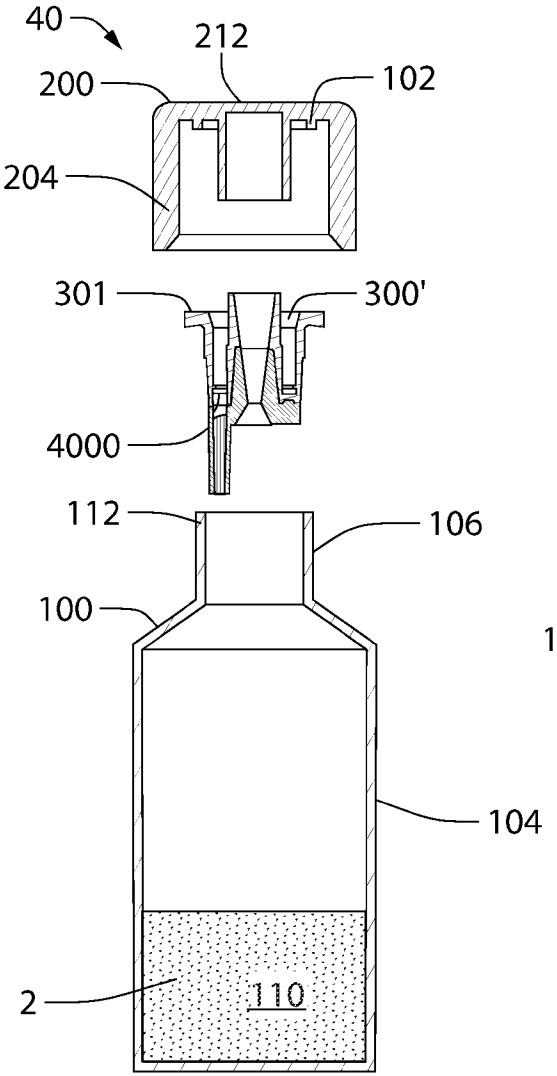
FIG. 8A is an exploded cross-sectional view of a container for storing moisture sensitive products, the container including a dispensing member having a portion made of a desiccant material to be disposed within a headspace of an enclosure formed by the cap and body of the container in accordance with an alternative optional aspect of the disclosed concept.

FIGS. 8A-C illustrates a cross section of a container 40 for storing moisture sensitive products suspended in the oil 2 in accordance with an optional aspect of the disclosed concept. The container 40 has similar features and components as the container 20,30 except that the dispensing member 300' of the container 40 includes an upper section 301 that is not made of a desiccant material and a lower section 4000 that is made of the desiccant material; there is no desiccant compartment; and the lower section 4000 may be disposed at least in part within the headspace (the enclosure excluding the product compartment 110) when the body 100 is in the resting position.

The container 40 includes the body 100, the oil 2, the cap 200, and the dispensing member 300'. The body 100 has the base 102, the sidewall 104 extending upwardly from the base 102 and leading to an opening that provides access to an interior of the body 100. The oil 2 is disposed within the product compartment 110 in the interior of the body 100. The product compartment 110 is that portion of the interior of the body 100 in which the oil 2 is disposed while the body 100 is standing upright on the base 102 in a resting position. The cap 200 covers the opening to form an enclosure that includes the product compartment 110 and a headspace positioned above and in fluid communication with the product compartment 110. The dispensing member 300' sealingly engages with an upper section 106 of the body 100 and has an outlet 316 configured to dispense a dosage of the products suspended in the oil 2 when the body 100 is oriented upside down in the dispensing position.

The dispensing member 300' also includes an upper section 301 that is not made of a desiccant material and a lower section 4000 that is made of the desiccant material. The lower section 4000 made of the desiccant material may be disposed at least in part within the headspace when the body 100 is in the resting position. The desiccant material is configured to scavenge moisture from the enclosure so as to stabilize moisture sensitive products suspended in the oil 2.

The dispensing member 300' further includes a flange 302 sealingly engaging with a portion 112 of the upper section 106 of the body 100, a first dispensing member sidewall 304 depending downwardly from the flange 302 and inwardly towards a bottom portion of the outlet 316, a dispensing member base 306 extending inwardly from a bottom edge of the first dispensing member sidewall 304 and forming a dispensing member opening 310 and a dispensing member base opening 308, a second dispensing member sidewall 312 extending upwardly from an inner periphery of the dispensing member base opening 308 towards a top portion of the outlet 316, and a projection 318 extending downwardly from the dispensing member opening 310. The first and second dispensing member sidewalls 304,312 and the dispensing member base 306 together form the groove 314 that is a part of the headspace.

Optionally, the projection 318 has a projection opening 320 opposite the dispensing member opening 310. The projection opening 320 and the dispensing member opening 310 together enable the groove 314 to be in fluid communication with the product compartment 110 or a remaining portion of the headspace. Optionally, the lower section 4000 of the dispensing member 300' includes the projection 318, the dispensing member base 306, a lower portion of the second dispensing sidewall 312, and a bottom portion of the outlet 316. Optionally, the desiccant material is molded onto the dispensing member 300 in a multi-shot injection process. The products include lactic-acid producing bacteria, optionally including *Lactobacillus* and *Bifidobacteria.*

In this embodiment, the desiccant material 4000 has an even more volume than the desiccant material 3000 of the container 30, thereby providing an even more scavenging capacity and stabilizing of the lactic-acid bacteria culture suspended in the pharmaceutical oil 2 without changing the quantity or volume of the oil 2 inside the container 40. Further, by allowing a portion of the projection 318 to make a direct contact with the oil 2, the container 40 in this embodiment allows the desiccant material 4000 to adsorb moisture directly from the oil 2 and also from the headspace of the container 40. Further, as the oil 2 is dispensed, the projection 318 of the dispensing member 300 reaches a point at which it no longer makes a direct contact with the oil 2. Subsequent to that point, the desiccant material 4000 may scavenge moisture from the oil 2 without directly contacting the oil 2, thereby providing even more scavenging and stabilizing capacity without directly contacting the oil 2 due to its larger available volume of the desiccant material 4000 within the container 40 as compared to that of the desiccant material 2000, 3000 of FIGS. 6A-7C.

In an optional aspect of the disclosed concept, a method for stabilizing moisture sensitive products suspended in oil is provided.

In accordance with this method, a container is provided. The container includes (i) a body that has a base, a sidewall extending upwardly from the base and leading to an opening that provides access to an interior of the body, (ii) a cap that covers the opening to form an enclosure that includes a product compartment that is a portion of the interior of the body in which an oil is disposed while the body is standing upright on the base in a resting position, the enclosure further including a desiccant compartment positioned above and in fluid communication with the product compartment, and (iii) a desiccant material disposed within the desiccant compartment.

The desiccant material in the container scavenges moisture from the enclosure, so as to stabilize moisture sensitive products suspended in the oil without directly contacting the oil when the body is in the resting position.

Optionally, the desiccant material is disposed at a lower section of the desiccant compartment and surrounds a lower portion of the second dispensing member sidewall. Optionally, the desiccant material has a shape of a ring. Optionally, the cap includes a blocking element that extends downwardly into the desiccant compartment and surrounds a portion of the second dispensing member sidewall when the cap is closed. The blocking element of the cap is made of the desiccant material. Optionally, providing the container includes molding the desiccant material onto the cap in a multi-shot injection process.

In another optional aspect of the disclosed concept, another method for stabilizing moisture sensitive products suspended in oil is provided.

In accordance with this method, a container is provided. The container includes (i) a body that has a base, a sidewall extending upwardly from the base and leading to an opening that provides access to an interior of the body, (ii) a cap that covers the opening to form an enclosure that includes a product compartment that is a portion of the interior of the body in which an oil is disposed while the body is standing upright on the base in a resting position, and (iii) a dispensing member that sealingly engages with an upper section of the body and has an outlet configured to dispense a dosage of the oil when the body is in a dispensing position, the dispensing member comprising an upper section that is not made of a desiccant material and a lower section that is made of the desiccant material, the desiccant material being disposed at least in part within the headspace when the body is in the resting position. The desiccant material in the container scavenges moisture from the enclosure, so as to stabilize moisture sensitive products suspended in the oil when the body is in the resting position.

Optionally, the cap is open and the body is oriented upside down in the dispensing position. Optionally, the dispensing member further includes a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming a dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming a groove that is a part of the headspace. Optionally, the dispensing member also includes a projection extending downwardly from the dispensing member opening, the projection having a projection opening opposite the dispensing member opening, the projection opening and the dispensing member opening together enabling the groove to be in fluid communication with the product compartment or a remaining portion of the headspace. Optionally, the lower section of the dispensing member includes the projection, the dispensing member base, a lower portion of the second dispensing sidewall, and a bottom portion of the outlet. Optionally, providing the container includes molding the desiccant material in a multi-shot injection process.

The following exemplary embodiments further describe optional aspects of the presently disclosed technology and are part of this Specification. These exemplary embodiments are set forth in a format substantially akin to claims (each with numerical designations followed by a capital letter), although they are not technically claims of the present application. The following exemplary embodiments refer to each other in dependent relationships as "embodiments" instead of "claims."

1A. A container for storing moisture sensitive products, comprising:

a body having a base, a sidewall extending upwardly from the base and leading to an opening that provides access to an interior of the body;

an oil disposed within a product compartment in the interior of the body, the product compartment being that portion of the interior of the body in which the oil is disposed while the body is standing upright on the base in a resting position;

a cap that covers the opening to form an enclosure that includes the product compartment, the enclosure further including a desiccant compartment positioned above and in fluid communication with the product compartment;

a desiccant material disposed within the desiccant compartment configured to scavenge moisture from the enclosure so as to stabilize moisture sensitive products suspended in the oil without directly contacting the oil when the body is in the resting position; and a dispensing member that comprises an outlet that is configured to dispense a dosage of the oil while the cap is open and the body is being oriented upside down in a dispensing position, the dispensing member sealingly engaging with an upper section of the body, the dispensing member further comprising a dispensing member opening that enables the desiccant compartment to be in fluid communication with the product compartment.

1B. The container of embodiment 1A, wherein the outlet is a spout.

1C. The container of embodiment 1B, wherein the spout comprises the upper lip forming an upper orifice, a lower lip forming a lower orifice, and a spout wall extending downwardly from the upper lip and tapering down to the lower lip.

2A. A container for storing moisture sensitive products, comprising:

a body having a base, a sidewall extending upwardly from the base and narrowing at an upper section of the body to form a neck leading to an opening that provides access to an interior of the body;

an oil disposed within a product compartment in the interior of the body, the product compartment being that portion of the interior of the body in which the oil is disposed while the body is standing upright on the base in a resting position;

a cap that covers the opening to form an enclosure that includes the product compartment, the enclosure further including a desiccant compartment positioned above and in fluid communication with the product compartment;

a dispensing member configured to secure to the neck of the body and comprising a non-active polymer section and an active polymer section, the non-active polymer section comprising a top portion of a spout configured to dispense a dosage of the products suspended in the oil when the body of the container is oriented upside down, the active polymer section configured to scavenge moisture from the enclosure so as to stabilize moisture sensitive products suspended in the oil when the body is in the resting position.

2B. The container of embodiment 2A, wherein the cap includes a deck, a skirt depending downwardly from the deck and configured to secure to an outer surface of the neck within the skirt, a cylindrical blocker depending downwardly from an inner surface of the deck, an exterior annular sealing ridge concentrical to the cylindrical blocker and extending downwardly from the inner surface of the deck, the exterior annular ridge disposed between the skirt and the cylindrical blocker.

2C. The container of embodiment 2B, wherein the dispensing member includes a flange configured to sealingly engage with the annular sealing ridge of the cap and the neck of the body, a groove region which is formed by a first annular wall depending downwardly in a slope from an inner periphery of the flange, an annular base extending radially inwardly from an edge of the first annular wall and forming a concentric opening and an edge opening, and a second annular wall extending upwardly from the concentric opening to an upper lip of the spout, the groove region configured to receive the cylindrical blocker of the cap when the cap is closed.

2D. The container of embodiment, wherein the active polymer section includes a bottom portion of the spout, an extended base portion extending radially downwardly and outwardly from a lower orifice of the spout and a tubular element extending downwardly from the edge opening into a portion of the enclosure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A container for storing moisture sensitive products, comprising:

a body having a base, a sidewall extending upwardly from the base and leading to an opening that provides access to an interior of the body;

an oil disposed within a product compartment in the interior of the body, the product compartment being that portion of the interior of the body in which the oil is disposed while the body is standing upright on the base in a resting position;

a cap that covers the opening to form an enclosure that includes the product compartment, the enclosure further including a desiccant compartment positioned above and in fluid communication with the product compartment;

a dispensing member that comprises an outlet that is configured to dispense a dosage of the oil while the cap is open and the body is being oriented upside down in a dispensing position, the dispensing member sealingly engaging with an upper section of the body, the dispensing member further comprising a dispensing member opening that enables the desiccant compartment to be in fluid communication with the product compartment; and a desiccant material disposed within the desiccant compartment configured to scavenge moisture from the enclosure so as to stabilize moisture sensitive products suspended in the oil without directly contacting the oil when the body is in the resting position.

2. The container of claim 1, wherein the dispensing member comprises the desiccant compartment.

3. The container of claim 1, wherein the dispensing member further comprises a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming the dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming the desiccant compartment.

4. The container of claim 3, wherein the projection has a projection opening opposite the dispensing member opening, the projection opening and the dispensing member opening together enabling the desiccant compartment to be in fluid communication with at least the product compartment or a remaining portion of the enclosure.

5. The container of claim 3, wherein the cap comprises a blocking element that extends downwardly into the desiccant compartment and surrounds a portion of the second dispensing member sidewall when the cap is closed.

6. The container of claim 5, wherein the blocking element of the cap is made of the desiccant material, which is molded into the cap in a multi-shot injection process.

7. A container for storing moisture sensitive products, comprising:

a body having a base, a sidewall extending upwardly from the base and leading to an opening that provides access to an interior of the body;

an oil disposed within a product compartment in the interior of the body, the product compartment being that portion of the interior of the body in which the oil is disposed while the body is standing upright on the base in a resting position;

a cap that covers the opening to form an enclosure that includes the product compartment and a headspace positioned above and in fluid communication with the product compartment; and a dispensing member sealingly engaging with an upper section of the body, the dispensing member having an outlet configured to dispense a dosage of the oil when the body is in a dispensing position, the dispensing member comprising an upper section that is not made of a desiccant material and a lower section that is made of the desiccant material, the desiccant material being disposed at least in part within the headspace when the body is in the resting position, the desiccant material being configured to scavenge moisture from the enclosure so as to stabilize moisture sensitive products suspended in the oil.

8. The container of claim 7, wherein in the dispensing position the cap is open and the body is oriented upside down.

9. The container of claim 7, wherein the dispensing member further comprises a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming a dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming a groove that is a part of the headspace.

10. The container of claim 9, wherein the projection has a projection opening opposite the dispensing member opening, the projection opening and the dispensing member opening together enabling the groove to be in fluid communication with the product compartment or a remaining portion of the headspace, wherein the lower section of the dispensing member comprises the projection, the dispensing member base, a lower portion of the second dispensing sidewall, and a bottom portion of the outlet.

11. The container of claim 7, wherein the products comprise lactic-acid producing bacteria.

12. A method for stabilizing moisture sensitive products suspended in oil, the method comprising:

providing a container that includes (i) a body that has a base, a sidewall extending upwardly from the base and leading to an opening that provides access to an interior of the body, (ii) a cap that covers the opening to form an enclosure that includes a product compartment that is a portion of the interior of the body in which an oil is disposed while the body is standing upright on the base in a resting position, the enclosure further including a desiccant compartment positioned above and in fluid communication with the product compartment, (iii) a dispensing member that comprises an outlet that is configured to dispense a dosage of the oil while the cap is open and the body is oriented upside down in a dispensing position, the dispensing member sealingly engaging with an upper section of the body, the dispensing member further comprising a dispensing member opening that enables the desiccant compartment to be in fluid communication with the product compartment and (iv) a desiccant material disposed within the desiccant compartment; and scavenging moisture, by the desiccant material, from the enclosure, so as to stabilize moisture sensitive products suspended in the oil without directly contacting the oil when the body is in the resting position.

13. The method of claim 12, wherein the dispensing member further comprises a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming the dispensing opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming the desiccant compartment.

14. The method of claim 13, wherein the cap comprises a blocking element that extends downwardly into the desiccant compartment and surrounds a portion of the second dispensing member sidewall when the cap is closed.

15. The method of claim 14, wherein the blocking element of the cap is made of the desiccant material.

16. A method for stabilizing moisture sensitive products suspended in oil, the method comprising:

providing a container that includes (i) a body that has a base, a sidewall extending upwardly from the base and leading to an opening that provides access to an interior of the body, (ii) a cap that covers the opening to form an enclosure that includes a product compartment that is a portion of the interior of the body in which an oil is disposed while the body is standing upright on the base in a resting position, and (iii) a dispensing member that sealingly engages with an upper section of the body and has an outlet configured to dispense a dosage of the oil when the body is in a dispensing position, the dispensing member comprising an upper section that is not made of a desiccant material and a lower section that is made of the desiccant material, the desiccant material being disposed at least in part within the headspace when the body is in the resting position; and scavenging moisture, by the desiccant material, from the enclosure so as to stabilize moisture sensitive products suspended in the oil when the body is in a resting position.

17. The method of claim 16, wherein the cap is open and the body is oriented upside down in the dispensing position.

18. The method of claim 16, wherein the dispensing member further comprises a flange sealingly engaging with a portion of the upper section of the body, a first dispensing member sidewall depending downwardly from the flange and inwardly towards a bottom portion of the outlet, a dispensing member base extending inwardly from a bottom edge of the first dispensing member sidewall and forming a dispensing member opening and a dispensing member base opening, a second dispensing member sidewall extending upwardly from an inner periphery of the dispensing member base opening towards a top portion of the outlet, and a projection extending downwardly from the dispensing member opening, the first and second dispensing member sidewalls and the dispensing member base together forming a groove that is a part of the headspace.

19. The method of claim 18, wherein the dispensing member further comprises a projection extending downwardly from the dispensing member opening, the projection having a projection opening opposite the dispensing member opening, the projection opening and the dispensing member opening together enabling the groove to be in fluid communication with the product compartment or a remaining portion of the headspace.

* * * * *